United States Patent [19]

Potter

[11] Patent Number: 4,890,601

[45] Date of Patent: Jan. 2, 1990

[54] GAS BURNER

[75] Inventor: Barry C. Potter, Brailsford, United Kingdom

[73] Assignee: Gas Logs (Brailsford) Ltd., Derby, Great Britain

[21] Appl. No.: 232,287

[22] Filed: Aug. 15, 1988

[30] Foreign Application Priority Data

Aug. 20, 1987 [GB] United Kingdom ..... 8719655

[51] Int. Cl.[4] ..... F24C 3/00; F23D 14/12

[52] U.S. Cl. ..... 126/512; 431/328; 431/354

[58] Field of Search ..... 126/512; 431/354, 328, 431/125

[56] References Cited

U.S. PATENT DOCUMENTS

| | | | |
|---|---|---|---|
| 1,507,791 | 9/1924 | Packer | 431/354 |
| 3,385,651 | 5/1968 | Rasmussen et al. | 431/328 |
| 3,561,902 | 2/1971 | Best | 431/328 |
| 3,583,845 | 6/1971 | Pulone | 431/328 X |
| 3,837,789 | 9/1974 | Shindler et al. | 431/354 |
| 4,110,063 | 8/1978 | Mitchell | 431/328 X |
| 4,723,513 | 2/1988 | Vallett et al. | 431/328 X |

FOREIGN PATENT DOCUMENTS

| | | |
|---|---|---|
| 0194157 | 3/1985 | European Pat. Off. . |
| 0223634 | 10/1985 | European Pat. Off. . |
| 1222354 | 2/1971 | United Kingdom . |
| 1259080 | 1/1972 | United Kingdom . |
| 1579829 | 11/1980 | United Kingdom . |
| 2160642 | 5/1985 | United Kingdom . |
| 2182431 | 2/1986 | United Kingdom . |

*Primary Examiner*—Randall L. Green

*Attorney, Agent, or Firm*—Lorusso & Loud

[57] ABSTRACT

Gas burner for a liquid petroleum gas artificial log or coal fire comprises a first tube having holes at spaced intervals along its length and a second tube housed within the tube, and means by which a combustible mixture of gas and air can be introduced into the second tube at a first end thereof. The second tube is open at its end remote from its first end and suitably spaced from an end wall closing the tube so that the combustible mixture travels along the second tube leaving its remote end and back along the first tube which it leaves through the holes. The tube extends lengthwise in a tray in which heat-resistant material e.g. mineral fibres dissipate gas so that flames rise between logs supported on a frame in the tray.

20 Claims, 3 Drawing Sheets

GAS BURNER

FIELD OF THE INVENTION

This invention relates to gas burners and especially to burners for burning liquid petroleum gas (third family gases), for example propane and butane, and for burning second family gas such as natural gas.

Currently fires fueled by natural gas but which appear to be log or coal fires are popular, using the gas to heat artificial logs or coals so that heat is radiated from them, as well as by the flames, while they remain intact and are not consumed by the flames. However, when attempting to produce such fires for use with third family gases e.g. liquid petroleum gas (propane), the gas burners which have been devised previously have not proved altogether satisfactory. Either they have burnt gas rapidly, thus being very expensive to run, some also burning with an unnatural blue flame, or, on other burners, there has been a tendency for undue quantities of soot to be produced which rapidly causes the artificial logs to become unsatisfactory. Burners intended to give an artificial coal or log effect are described in, for example, UK patent application Ser. Nos. 2160642 and 2182431 and European patent application Ser. No. 0194157. Of these only application No. 2160642 shows a burner having individual artificial coals or logs which can be positioned, as desired, on the burner. In practice, furthermore, such burners have not been altogether satisfactory for one or more of the reasons outlined above, especially for third family gases.

SUMMARY OF THE INVENTION

In one of its aspects, the invention provides a gas burner comprising a tray, a first tube mounted in the tray extending lengthwise thereof. The tube is closed at both ends and has holes at spaced intervals along its length. A second tube is housed within the first tube, and extends substantially along the length thereof. Means by which a combustible mixture of gas and air can be introduced into the second tube at a first end portion thereof is also provided. The second tube is open at the end remote from said first end portion so that in use said combustible mixture travels along the second tube and back along the first tube which it leaves through the holes. The tray in which the first tube is mounted is shallow, and the lengthwise axis of the tube extends lengthwise of the tray. In the tray a heat-resistant material is arranged to dissipate gas expelled from the first tube through the holes so that clean, natural-coloured flames rise up through artificial logs or coals which may be supported on a support frame which is part of the tray or a suitably positioned separate article.

The heat-resistant material suitably comprises mineral fibres, (including rock wool fibres) supplied under the name "Ember Glow". The material must be sufficiently heat-resistant to withstand the burning temperatures of the combustible air/gas mixture: the "Ember Glow" mineral wool fibres will withstand a temperature of about 3000° F. (about 1650° C.). Some of the other materials which have been used in this type of fire for combusting natural gas are unsatisfactory —for example the material known as vermiculite is unsatisfactory. The burner is especially suitable for use with artificial ceramic logs comprising Californian clays supplied under the Trade Name REAL-FYRE available from the applicant company.

In a burner in accordance with the invention it is important to ensure that the cross-sectional areas of the first and second tubes are in the correct ratio. For example, in a preferred burner, the first tube may be conveniently rectangular in section having sides approximately 50 mm in width and 20 mm high (i.e. about 10 $cm^2$ in cross-sectional area) and the second tube is suitably of circular cross-section and about 20 mm in diameter (i.e. about 3 $cm^2$ in cross-sectional area); however, its relative cross-sectional area is more important than its shape and it may be, for example, square or rectangular in shape.

In a burner in accordance with the invention the number and distribution of the spaced holes is chosen to be such as to give the desired flame distribution in the fire. Preferably the holes are evenly spaced: holes spaced at about 5 cm. intervals have been found satisfactory in the preferred burner. The size of the holes is chosen to be such that the gas may escape from within the first tube easily but not so great that flash-back occurs i.e. there must be no ignition of the gas within the first tube. The holes are conveniently between about 1.5 mm. and about 6.5 mm. in diameter; holes of about 4 mm. diameter have been found satisfactory in the preferred burner. If desired, deflector means may be positioned adjacent the holes to further improve flame distribution.

Whilst the preferred first tube is completely closed at both ends, if desired appropriate holes for the production of flames may likewise be positioned in the ends, though this is not preferred.

Where a burner in accordance with the invention is to be used in a fire which is open at one side only, the holes may be formed in front and rear sides of the first tube, there being a greater number of holes at the front than at the rear. Where the burner is to be used in a basket fire, open at both sides, an equal number of holes may be formed at both sides of the burner. A burner may also be provided for use in a banked fire in which case the first tube may be positioned at the rear of a tray supporting the heat-resistant, flame-dissipating material e.g. mineral fibres and the holes through which the gas issues from the first tube may be conveniently formed in only the front surface of the first tube. Where deflector means is used this may suitably be a flat plate positioned above the front or rear holes and preferably projecting at least 25 mm, or more preferably about 50 mm, from the first tube.

Further holes, preferably of smaller area than those in the front and rear sides of the first tube suitably about 1.5 mm in diameter, may if desired be provided in an upper side of the first tube and may further improve the flame distribution. The number of holes formed in the upper side may suitably be similar to the number of holes provided in the front side of the first tube and those holes provided in the front region of the upper side. Where there are also holes in the rear side, holes may also be provided in the rear region of the upper side, suitably similar in number to those in the rear side. Alternatively, the holes in the upper side may be spaced along a line equidistant from the front and rear sides, or staggered alternately at opposite sides of this line. The total hole area of holes in the upper side is preferably less than half more preferably less than one quarter the total hole area of holes in the front and rear sides. Preferably the ratio of total area of holes in front and rear sides to the total hole area in the upper side is between 4 to 1 and 8 to 1, suitably about 6:1. The relative areas of individual holes in front and rear, and upper, sides of the first tube also desirably fall within the same limits. Thus, in use, most of the gas is expelled through the holes in the front and rear sides.

The means by which a combustible mixture of gas and air can be introduced into the second tube is conveniently provided by a gas jet through which gas issues, the jet suitably being spaced about 16 mm from the end of the second tube and being disposed to direct a stream of gas into the first end portion of the second tube. The stream of gas draws air into the tube from around the gas inlet jet. The size of jet is chosen dependent on the size of fire to be supplied, to deliver an appropriate amount of gas. Desirably means may be provided to reduce the hissing noise arising as gas issues from the jet, for example by providing an inwardly tapering mouth at the entrance to the second tube into which the jet of gas issues.

There now follows a detailed description, to be read with reference to the accompanying drawings of a gas fire comprising a gas burner, embodying the invention. It will be realised that this fire has been selected for description by way of example.

DESCRIPTION OF THE PREFERRED EMBODIMENT

Figure 3:
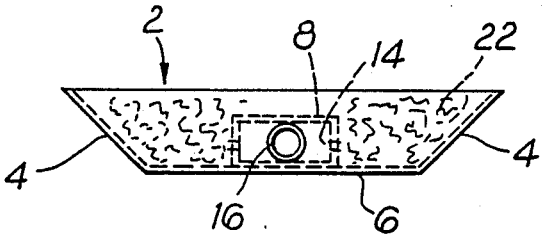
FIG. 3 is a view in end elevation of the burner shown in FIG. 1.

The first illustrative burner comprises a tray 2 which is rectangular in plan view and is closed at either end by end walls. The tray 2 is suitably about 46 cms long and about 28 cms wide. The tray is approximately 4 cms deep and is of trapezoidal cross-section (see FIG. 3) having front and rear faces 4 inclined outwardly upwardly from the base of the tray 6, the front and rear faces 4 extending lengthwise of the tray 2.

A first tube 8 of rectangular cross-section, about 50 mm wide and 20 mm high, extends lengthwise of the tray 2 and is secured to the base 6 in a central region thereof. The tube 8 is closed at both ends and comprises a plurality of holes 14 at spaced intervals along its length in front and rear faces 10, 12. The holes 14 in the front face are spaced apart at approximately 4.5 cm intervals; there are eight holes in the front face 10. There are a fewer number of holes 14 in the rear face 12 and, in the first illustrative embodiment, in fact, four such holes spaced at equal intervals from one another. The holes 14 need not be spaced at equal intervals if desired and may be distributed differently between the front and rear faces 10, 12 of the tube 8 depending upon the flame pattern required and the type of fireplace in which the burner is to be installed.

A second tube 16 is mounted within the first tube and extends lengthwise, along substantially the whole length thereof, positioned approximately centrally of the first tube. In the illustrative embodiment the second tube 16 is of circular cross-section and about 20 mm in diameter so that it effectively divides the first tube 8 into two chambers (front and rear) of approximately equal cross-section area. However, in a burner otherwise generally similar to the illustrative burner, the second tube may not extend across the whole height of the first tube. A first end portion of the tube 16 projects through the end wall of the first tube 8, (to which it is sealed so that gas cannot leak from the first tube 8) and beyond the tray 2. A gas inlet jet 18 is mounted adjacent the first end portion to direct a stream of gas from the jet 18 into the second tube 16, in the operation of the burner. The outlet of the jet is spaced about 16 mm from the adjacent end of the second tube 16. The end of the tube 16 remote from the jet 18 terminates spaced at a suitable distance from the end wall 20 closing the first tube 8 remote from the jet 18; in the illustrative burner, the second tube 16 terminates about 40 mm from the end wall 20 of the first tube 8.

Figure 1:
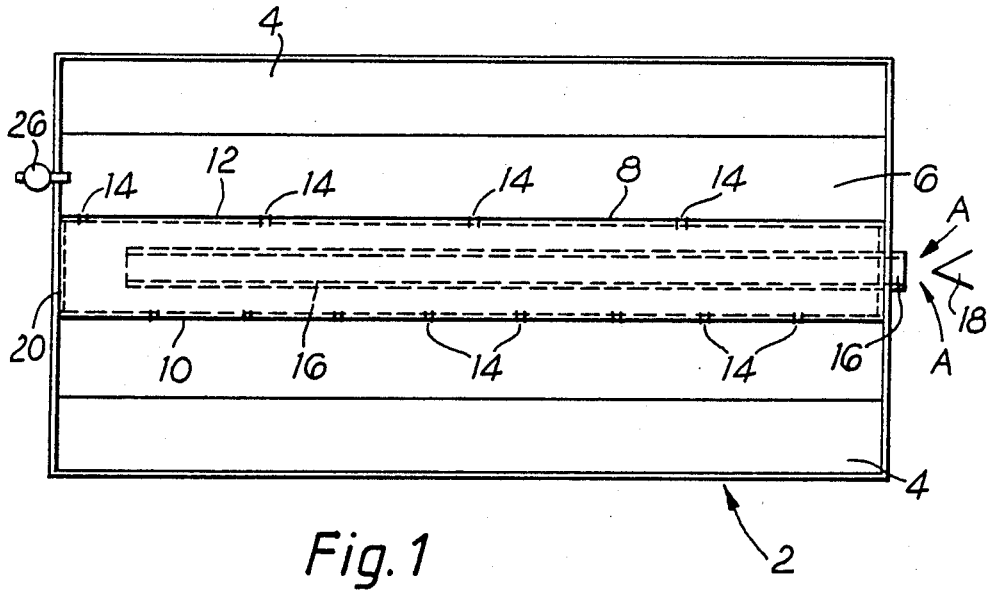
FIG. 1 is a diagrammatic plan view of a burner embodying the invention.
Figure 2:
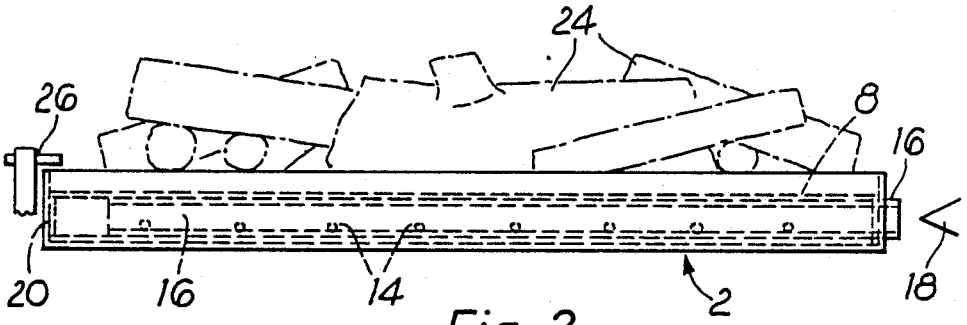
FIG. 2 is a view in front elevation of the burner shown in FIG. 1.

The tray 2 is filled with a suitable material for dissipation of the flames in the operation of the burner, for example mineral fibre 22 (see FIG. 3) supplied by the applicant company under the designation "Ember Glow". The tray 2 may be provided with support means (not shown) for example bars secured to an upper edge portion of the front and rear faces 4 extending from front to rear of the tray 2 and further bars extending from end to end of the tray 2, to support artificial logs or coals. The bars are subject to considerable beat; whilst iron or steel may be suitable, it is preferably provided with an aluminum coating which may be sprayed on. In use this oxidises to provide a secure highly heat-resistant finish. In FIG. 2 artificial logs 24 are shown in position on the top of the tray. The illustrative gas burner further comprises a pilot light jet 26 which is mounted at an end portion of the tray remote from the gas inlet jet 18 and adjacent one of the holes 14 from the first tube. The illustrative gas burner also comprises suitable control means for controlling ignition of gas and rate of gas supply of known construction (not shown in the drawings).

In the operation of the first illustrative burner suitable gas, for example liquid petroleum gas e.g. butane or propane, is supplied at an appropriate pressure to the gas inlet jet 18 so that a stream of gas is directed into the inlet end of the second tube 16; the stream of gas draws with it into the second tube 16 air, indicated by the arrows A, so that a combustible mixture is supplied into the second tube 16. The gas/air mixture travels along the tube 16 and spills out of the end remote from the jet 18, travelling back along either side of the tube 16 within the first tube 8 from which the gas/air mixture escapes through the holes 14. The gas escaping from the holes 14 is ignited by the pilot light 26 and the temperature of the fire is controlled in the usual manner by the above-mentioned known control means. The flames are dissipated by the mineral fibre 22 in the tray 2 and dispersed upwardly amongst the artificial logs 24 (preferably logs supplied under the name Real-Fyre by the applicant company).

The gas is found to burn with long clean flames of natural colour without generation of significant amounts of soot.

In the first illustrative burner a baffle plate projecting approximately 25 mm from the front face 10 may, if desired, be positioned parallel with the bottom plate 6 above the holes 14 to deflect the flames forwardly and produce a flame distribution so that the burner is caused to radiate more heat from a front region thereof. Such deflector plates may be used where necessary in other burners in accordance with the invention. In a banked burner in accordance with the invention, the upper edges of the end walls of the tray 2 may slope downwardly from back to front; the rear wall of the tray may be substantially vertical with a small front wall providing a lip to retain the heat-resistant gas-dissipating material, for example mineral wool, in the tray. In this type of burner the first tube is conveniently disposed adjacent the rear wall of the tray, the holes 14 being disposed at equal intervals in a front face of the first tube.

Figure 4:
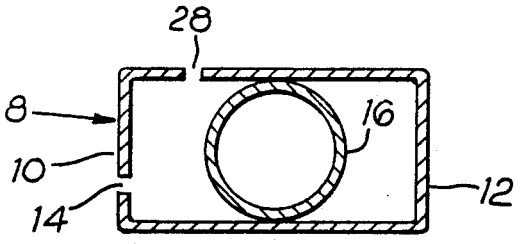
FIG. 4 is a diagrammatic view in section of part of a second burner embodying the invention.

Part of a second illustrative burner is shown in FIG. 4 of the drawings: like numbers represent like parts in the drawings.

The second illustrative burner is similar, except as herein described to the first illustrative burner and comprises a first tube 8 of similar shape and dimensions to the first tube of the first burner and likewise closed at both ends and provided with holes 14 at spaced intervals in front and rear faces 10, 12. Similarly a second tube 16 is mounted in the first tube 8. In addition, however, the second illustrative burner is provided with a plurality of holes 28, of smaller diameter than the holes 14, in an upper face of the first tube 8. The holes 28 are preferably positioned in a row in a front region of the upper face (where the fire is single sided). However the holes 28 may, if desired be distributed other than in a row or, for example in a two-way facing fire, in two rows, one in a front region, the other in a rear region of the upper face. Suitably the holes 28 may be spaced at about 5 cm intervals. The holes 28 are desirably smaller in diameter than the holes 14: for example, the holes 14 are about 4 mm in diameter, while the holes 28 are about 1.5 mm in diameter.

Figure 5:
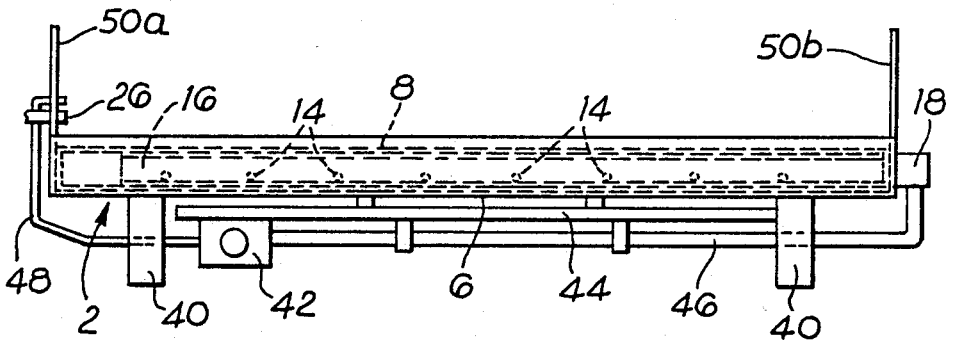
FIG. 5 is a diagrammatic view in front elevation of a third burner embodying the invention.
Figure 6:
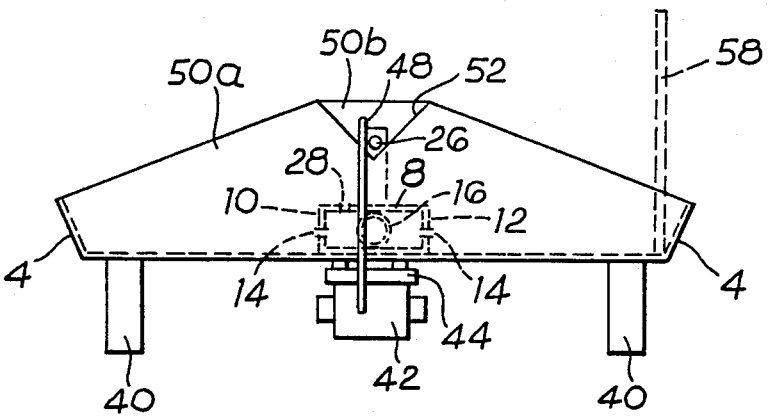
FIG. 6 is a view in end elevation of the third illustrative burner.
Figure 7:
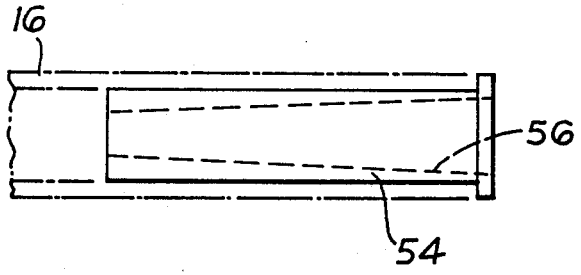
FIG. 7 is a view of an insert for a second tube of the third burner.

A third illustrative burner is shown in FIGS. 5 to 7 of the drawings. The third illustrative burner is generally similar to the first and second burners in many respects and like numbers represent like parts.

The third burner likewise comprises a first tube 8 of similar shape and dimensions to the first tube of the first burner and likewise closed at both ends and provided with holes 14 at equally spaced intervals in front and rear faces 10, 12. The holes 14 are provided in equal numbers in the front and rear faces 10, 12, as the third burner is suitable for use in a fire accessible from both sides. The third burner further comprises holes 28 of smaller diameter (about 1.5 mm.) than the diameter (about 4 mm.) of the holes 14 equally spaced apart at about 5 cm. intervals along a centre line of an upper face of the first tube 8.

The third burner comprises a tray 2 supported on legs 40 to raise the bottom of the tray 2 sufficiently to mount a control box 42 beneath the tray on a support 44 secured to but spaced from the base 6 of the tray 2. The control box 42 to control the gas supply is of known construction but may be damaged by exposure to undue heat: the mounting system adopted prevents heat damage. A supply pipe 46 extends from the control box 42 to the jet 18 to supply gas thereto. A pilot jet 26 is also supplied from the box 42 and a control thermocouple 48 connected to the box 42 and activated by the flame from the jet 26 acts as a safety device in the usual way.

The tray 2 has low, outwardly inclined front and rear walls 4 similar to the first burner but end walls **50*a*, 50*b* which rise to a peak at a central region. A V-shaped cut-out 52 in the end wall 50*a* provides access for the pilot jet 26 and thermocouple 48** to an appropriate position in the burner.

At the inlet end of the second tube 16 a mouth insert 54 having a tapering passage 56 is positioned so that the jet 18 directs gas into the widest end of the passage 56. The insert is short relative to the length of the second tube, e.g. about 7.5 cm. long. The passage 56 is about 1.5 cm. diameter at its inlet end and about 1 cm. at its exit. It appears that this reduces the volume of the hissing noise which accompanies flow of gas from the jet, in some circumstances, and also leads to increased flame size without increasing gas consumption.

The third illustrative burner can also be used in a backed fireplace, open at only one side, in which case a suitable metal plate 58 (indicated in dash line in FIG. 6) is positioned in the tray.

Figure 8:
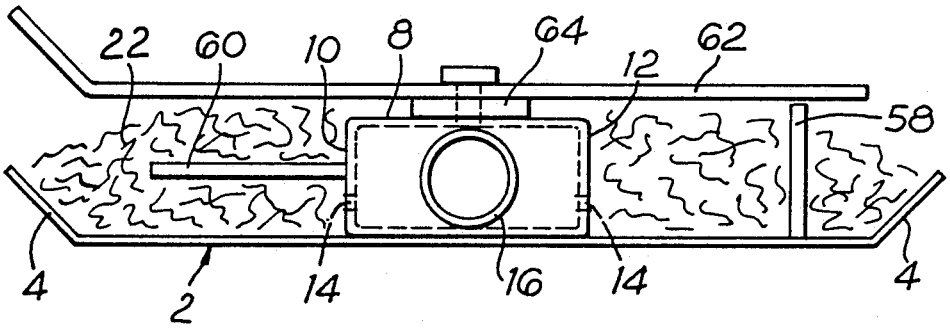
FIG. 8 is a diagrammatic view in end elevation of a fourth illustrative burner.

The fourth illustrative burner is shown in FIG. 8 of the drawings and is generally similar in many respects to the first, second and third burners; like numbers represent like parts.

The fourth burner has a tray having end walls (not shown in FIG. 8) of a similar shape to those shown in FIG. 6, that is reaching a peak adjacent the tube 8. The fourth burner shown in FIG. 8 is intended for use in a backed fireplace, though with minor changes it can be used in an open fireplace. The fourth burner is about 26 cms in depth and has first and second tubes 8, 16 of similar dimensions to those in the first burner. Spaced holes 14 are provided at intervals in front and rear faces 10, 12 and, if desired, in the upper surface of the tube 8. The fourth burner further comprises deflector means comprising a metal baffle plate 60 projecting parallel with the floor of the tray 2 from the tube 8 above the holes in the front face 10 for a distance of about 50 mm. The deflector means also comprises a substantially vertical metal baffle plate 58 projecting upwardly from the floor of the tray about 50 mm and positioned near the rear of the tray. The baffle plates 58, 60 assist in spreading the flame in a desired pattern. In two-sided e.g. basket fires, instead of the vertical plate 58, a plate similar to the plate 60 may be positioned above the holes 14 in the rear face 12.

The fourth burner further comprises a support frame for artificial logs or coals comprising a plurality of parallel metal bars 62 secured to the first tube 8 and extending transversely of the tray 2 across substantially the whole depth of the tray. If desired the frame may comprise lengthwise bars also. Preferably the frame is spaced slightly from the upper surface of the tube 8 by a spacer 64. Mineral fibres 22 are arranged in the tray below the support frame to dissipate the expelled gas/-flames in use and to provide a glowing base to the fire.

The tray 2, tubes 8, 16, plates 58, 60 and support frame including bars 62 form a self contained unit which is suitably positioned on a separate base framework (not shown) which carries the gas control and ignition system, pilot burner, thermocouple and gas inlet jet; thus the base framework can be installed, tested and adjusted with tray unit removed, and the unit then installed on the base. The tray unit can readily be removed for refurbishment or servicing of the appliance.

The remainder of the second, third and fourth illustrative burners may be similar to the first burner and the various modifications discussed above with reference to the first burner may likewise be made in respect of the second, third and fourth burners. The burners may be of various lengths and depths according to the fireplace in which they are installed, for example about 46 cm. 61 cm. and 76 cm. are three standard lengths which may be appropriate.

First and second tubes 8, 16 as described above are suitable for a tray of about 20 to 30 cm width. For trays of different width from front to rear, corresponding changes in the dimensions of the tubes and the like may be necessary. Alternatively two or more parallel first tubes 8 may be positioned at appropriate spacings to provide a satisfactory flame distribution across the width of wider trays.

The second, third and fourth burners provide an improved flame distribution in some circumstances.

All four illustrative burners burn third family gases e.g. propane more efficiently than many previously known burners for artificial log or artificial coal fires fuelled by third family gas, and with flames of more realistic appearance and which burn relatively cleanly.

I claim:

1. A gas burner comprising a tray, a first tube mounted in the tray, the tube being closed at both ends and having front and rear faces and a plurality of holes formed in at least the front face at spaced intervals along its length, a second tube housed within the first tube, and means for introducing a combustible mixture of gas and air into the second tube at a first end portion thereof, the second tube being open at the end remote from said first end portion so that in use said combustible mixture travels along the second tube and back along the first tube which it leaves through the holes and the first tube being mounted in the tray such that heat-resistant material can be arranged in the tray to dissipate gas expelled from the first tube through said holes in the operation of the burner.

2. A burner according to claim 1 wherein the heat-resistant material comprises mineral fibres.

3. A burner according to claim 1 wherein said holes are between 1.5 mm and 6.5 mm in diameter.

4. A burner according to claim 1 wherein said holes are about 4 mm in diameter.

5. A burner according to claim 1 comprising deflector means positioned above holes in the front and/or rear faces and projecting from the first tube.

6. A burner according to claim 1 wherein the first tube is substantially 10 $cm^2$ in cross-sectional area and the second tube is substantially 3 $cm^2$ in cross-sectional area.

7. A burner according to claim 1 wherein the first tube is rectangular in cross-section and is wider than it is high, and the second tube extends substantially centrally along the first tube, dividing it into front and rear chambers.

8. A burner according to claim 1 wherein the first tube is rectangular in cross-section and is wider than it is high, and the second tube extends substantially centrally along the first tube, dividing it into front and rear chambers and wherein the second tube is of substantially circular cross-section.

9. A burner according to claim 1 wherein said means for introducing a combustible mixture comprises a gas jet disposed to direct a stream of gas into the first end portion of the second tube.

10. A burner according to claim 1 comprising a passage at the first end portion of the second tube, tapering towards the second end portion, through which the combustible mixture of gas and air can be introduced.

11. A burner according to claim 1 wherein the end of the second tube remote from its first end portion is spaced substantially 40 mm from the end of the first tube remote from the first end portion.

12. A gas burner according to claim 1, said first tube having front and rear faces and a plurality of holes formed in said front and rear faces at spaced intervals along its length.

13. A burner according to claim 12 wherein the holes are evenly spaced and the holes in the rear face of the first tube are spaced at intervals the same as, or greater than the holes in the front face.

14. A burner according to claim 12 wherein said holes in the front side of the first tube are spaced at substantially 5 cm. intervals.

15. A gas burner comprising a tray, a first tube mounted in the tray, the tube being closed at both ends and having a plurality of holes formed in at least a front face and optionally a rear face, at spaced intervals along its length, a second tube housed within the first tube, and means by which a combustible mixture of gas and air can be introduced into the second tube at a first end portion thereof, the second tube being open at the end remote from said first end portion so that in use said combustible mixture travels along the second tube and back along the first tube which it leaves through the holes and the first tube being mounted in the tray such that heat-resistant material can be arranged in the tray to dissipate gas expelled from the first tube through said holes in the operation of the burner, the burner further comprising a plurality of spaced holes formed in an upper side of the first tube.

16. A burner according to claim 15 wherein the upper holes are of smaller area than the said plurality of holes.

17. A burner according to claim 15 wherein the upper holes are substantially 1.5 mm. in diameter.

18. A burner according to claim 15 wherein the total area of holes in the upper side of the tube is less than half the total area of said plurality of holes.

19. A burner according to claim 10 wherein the ratio of the total area of said plurality of holes to the total area of holes in the upper side is between 4 to 1 and 8 to 1.

20. A gas burner for generating a flame comprising:

a tray;

a first tube mounted in the tray, said first tube being closed at both ends and having front and rear faces and a plurality of holes formed at spaced intervals along its length in at least the front face;

a second tube housed within said first tube;

means for deflecting the flame projecting outward from said first tube to be positioned above said holes; and means for introducing a combustible mixture of gas and air into the second tube at a first end portion thereof, said second tube being open at the end remote from said first end portion so that in use said combustible mixture travels along the second tube and back along the first tube which it leaves through the holes, the first tube being mounted in the tray such that heat-resistant material can be arranged in the tray to dissipate gas expelled from the first tube through said holes.

* * * * *